US006957561B1

(12) United States Patent
Contreras

(10) Patent No.: US 6,957,561 B1
(45) Date of Patent: Oct. 25, 2005

(54) APPARATUS FOR PAINTLESS DENT REMOVAL

(76) Inventor: Salomon John Contreras, 326 24th Ave., San Mateo, CA (US) 94403

( * ) Notice: Subject to any disclaimer, the term of this patent is extended or adjusted under 35 U.S.C. 154(b) by 146 days.

(21) Appl. No.: 10/611,536

(22) Filed: Jun. 30, 2003

(51) Int. Cl.[7] ..... B21J 13/08
(52) U.S. Cl. ..... 72/458; 72/480; 72/481.3; 72/705
(58) Field of Search ..... 72/390.7, 457, 72/458, 459, 480, 481.3, 481.8, 705

(56) References Cited

U.S. PATENT DOCUMENTS

| | | | | |
|---|---|---|---|---|
| 119,770 A | | 10/1871 | Ives | |
| 206,902 A | | 8/1878 | Scribner | |
| 1,737,084 A | * | 11/1929 | Hilstad | 72/458 |
| 1,890,273 A | | 12/1932 | Wells | |
| 2,749,795 A | * | 6/1956 | Boykin, Jr. | 72/458 |
| 2,776,587 A | * | 1/1957 | Killius | 72/458 |
| 2,890,018 A | | 6/1959 | Johnson | |
| 2,894,720 A | | 7/1959 | Bennett | |
| 2,907,106 A | | 10/1959 | Lockwood | |
| 2,949,144 A | * | 8/1960 | Dredske et al. | 72/390.2 |
| 3,029,502 A | | 4/1962 | Middaugh | |
| 3,091,983 A | * | 6/1963 | Kliss | 72/458 |
| 3,134,574 A | | 5/1964 | Reuterfors | |
| 3,712,106 A | * | 1/1973 | Holsapple et al. | 72/309 |
| 3,836,119 A | | 9/1974 | Saucier et al. | |
| 4,042,210 A | | 8/1977 | Feldman | |
| 4,503,701 A | | 3/1985 | Hardy | |
| 4,828,734 A | | 5/1989 | Doner et al. | |
| 5,461,900 A | | 10/1995 | Gutiererez | |
| 5,479,804 A | | 1/1996 | Cook | |
| 5,893,291 A | * | 4/1999 | Salazar | 72/460 |
| 6,170,803 B1 | | 1/2001 | Liberfarb | |
| 6,199,456 B1 | | 3/2001 | Hlady | |
| 6,302,375 B1 | | 10/2001 | Heil et al. | |
| 6,543,270 B2 | | 4/2003 | Cmelik | |
| 6,792,790 B2 | * | 9/2004 | Ritter | 72/458 |

* cited by examiner

*Primary Examiner*—Ed Tolan
(74) *Attorney, Agent, or Firm*—Lorimer Labs; D'Arcy H. Lorimer

(57) ABSTRACT

A apparatus for the paint-less dent repair of vehicles, for applying a leverage force between a rigid internal structure and an inside surface of a panel to be straightened, is disclosed. The apparatus includes an elongated lever, a first tool head attached to the elongated lever proximate to the distal end, and a second tool head attached to the lever between the proximal end and the first tool head. The tool heads are attached to opposite sides of the lever facing opposing directions.

22 Claims, 11 Drawing Sheets

Fig 14 a
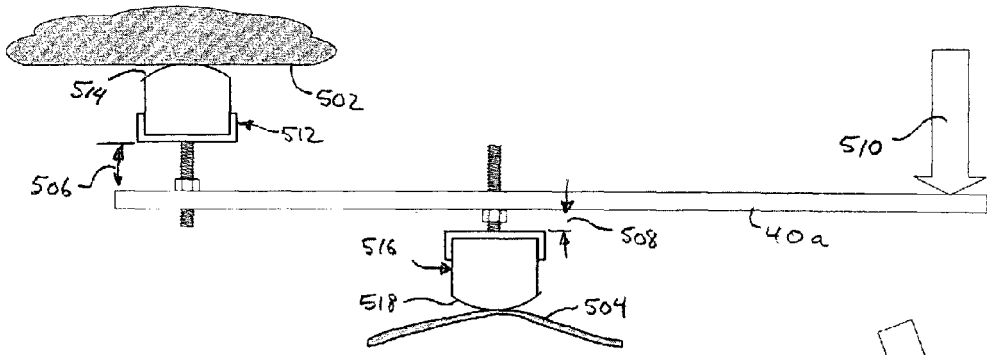
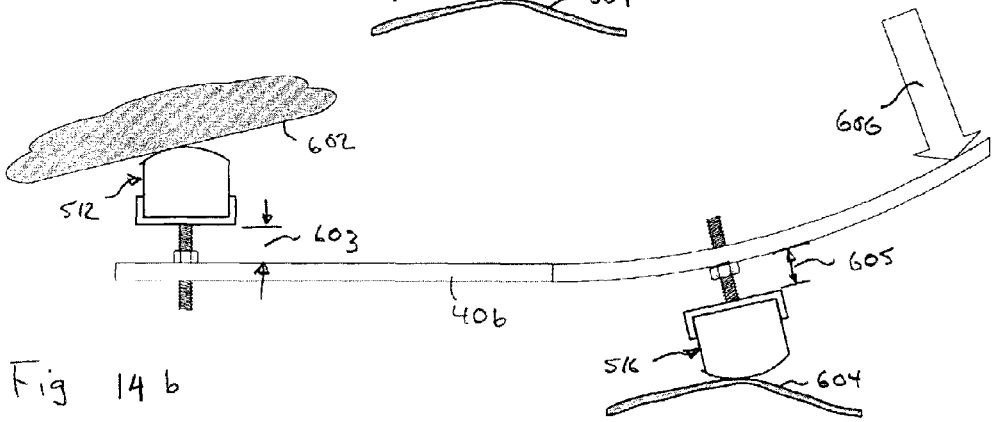
Fig 14 b
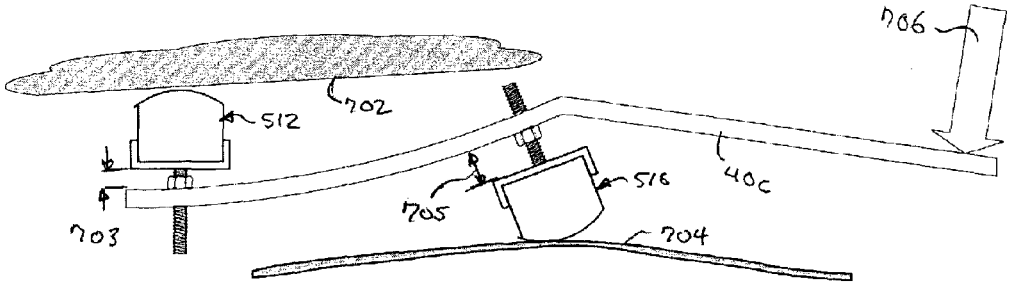
Fig 14 c

Fig 15 a
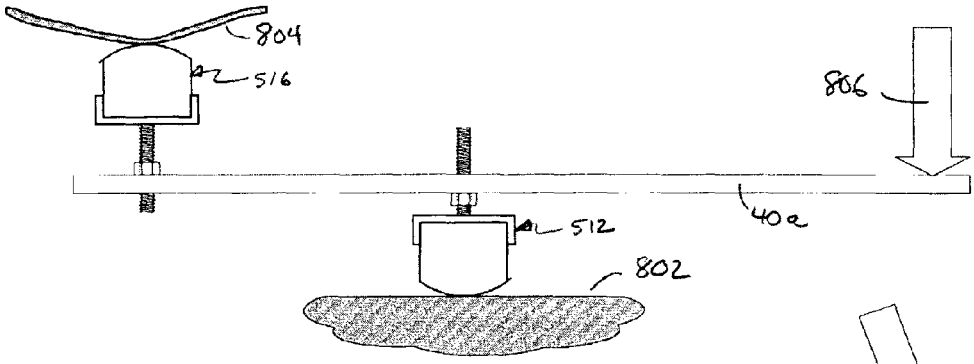
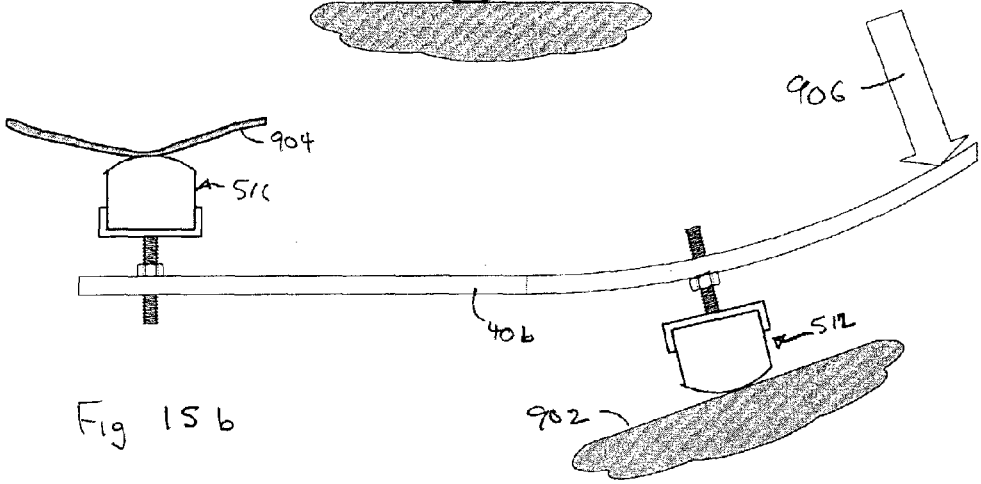
Fig 15 b
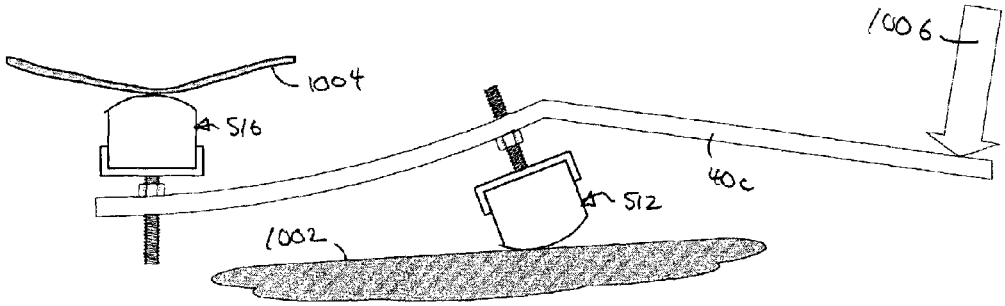
Fig 15 c

APPARATUS FOR PAINTLESS DENT REMOVAL

BACKGROUND OF THE INVENTION

1. Field of the Invention

This invention relates generally to the repair of dents or minor body damage in the sheet metal of vehicles, and more particularly to tools which can be effectively used in the field of paint-less dent repair, a specialized technique of metal-working that repairs dents without re-painting the damaged area.

2. The Prior Art

In vehicles, such as automobiles, the sheet metal becomes damaged for a number of reasons, including collisions with other vehicles or objects. Minor collisions will often result in denting of the sheet metal panels, where the integrity of the paint finish is not compromised, even though the sheet metal panel is permanently displaced from its original shape. Owners often want to repair such damage to maintain the resale value and original appearance of their vehicles. Preferably, owners desire to have repairs done without re-painting or breaching the integrity of the original finish, in order to maintain a higher resale value. This is especially important in the high end luxury vehicle market.

Heretofore, the practice of repairing dented sheet metal body panels has generally involved sanding or abrading the damaged area to remove the original paint finish, filling the depressions in the damaged surface to restore the original shape, and then re-painting the damaged area. In order to minimize the filler material used, a hole may be drilled in the sheet metal and various pulling tools (for example, as disclosed in U.S. Pat. No. 4,503,701) used to restore the surface approximately to its original shape. This technique, however, requires that the hole be repaired as well. Filler materials used to repair the aforementioned holes and restore surface geometry have questionable long term durability, and may create corrosion problems subsequent to the repair. It is generally acknowledged that such repairs will never have the long term durability of the original OEM (original equipment manufacturer) paint finish. This is exemplified in the reduced resale values of vehicles that have undergone typical repaint damage repair.

Thus, it is desirable to repair minor body damage without altering the original paint finish, using methods of paint-less dent repair. The prior art has described suction type devices that may be applied to the outside surface of the dent, allowing the dent to be pulled back into a desired shape. However, these devices often require the use of a bonding compound to increase the available pulling force, which may damage the paint finish. These devices rely on forceful contact with the outside painted surface for leverage, also increasing the potential to damage the painted surfaces. A more desirable method usually requires access to the inside surface of the dented panel, so that force can be selectively applied to restore the original shape. The complexity of modern vehicles has reduced accessibility to inside body panel surfaces, due to the inclusion of power locks, power windows, side air bags, impact-absorbing structures and other equipment. This complexity has previously required a large selection of tools of varying shapes and sizes, which can be expensive. Furthermore, the wide variety of dent shapes, body panel contours, panel thickness, and panel material requires a broad variety of tool tip shapes, tool tip compliance, and leverage force. Use of the tool tips must not create additional dents or damage, as this damage cannot be removed from inside the panel. Often, the restoring forces need be applied in multiple locations with different tool tips and varying force levels. Since no filler materials can be used in the repair to compensate for even minor contour irregularities, the original shape must be restored with a high degree of precision for the repair to be non-detectable. This requires a tool with a high degree of flexibility. Selecting from a large number of different tools of fixed configuration is not a desirable option when cost effective repairs need be accomplished.

For example, FIG. 1 shows a variety of tools 10–32 commercially available in the prior art. These tools have limited applicability for paint-less dent repair due to the sharp tips, hardened material of construction (spring steel), and limited leverage available in tight, narrow spaces. It is often important to apply the right amount of force, at the proper angle to the dented sheet metal, since the restoring process is trying to reverse the process that caused the dent in the first place. The tool must remain in place over the dent as reversing force is applied, and not slip off. Tools of the prior art have difficulty staying in place over the dent due to their sharp tips.

Therefore, there is a need for a paint-less dent repair tool that does not damage the exterior paint finish, can be used to repair a wide variety of dents, in a wide variety of locations, in a wide variety of vehicles with differing option packages, configuration and equipment. The paint-less dent repair tool must be easily re-configurable and adjustable to conform to a variety of difficult-to-reach areas. The paint-less dent repair tool must be adjustable to apply the appropriate force to wide variety of dent shapes, panel thickness and panel materials. Additionally, the paint-less dent repair tool must be adapted for use with a wide variety of interchangeable tips of varying shapes, sizes, and materials of construction.

SUMMARY OF THE INVENTION

It is an object of the present invention to provide a paint-less dent repair tool that does not damage the exterior paint finish, can be used to repair a wide variety of dents, in a wide variety of locations, in a wide variety of vehicles with differing option packages, configuration and equipment. It is another object of the present invention to provide a paint-less dent repair tool that is easily re-configurable and adjustable to conform to a variety of difficult-to-reach areas. It is another object of the present invention to provide a dent repair tool that is adjustable such that the appropriate force may be applied to wide variety of dent shapes, panel thickness and panel materials. It is a further object of the present invention that the paint-less dent repair tool be adapted for use with a wide variety of interchangeable tips of varying shapes, sizes, and materials of construction.

In one embodiment of the present invention, a device for the paint-less dent repair of vehicles includes a first and second removable tool head, each including a base having a top surface and a bottom surface, and a work-piece contacting portion fixed to the top surface. Each tool heads further includes a rod-like mounting portion having a mounting end and a tip support end, a central axis extending from the mounting end to the tip support end, and a screw thread extending over a portion of the outer surface between the mounting and tip support ends. The tip support end is fixed to the bottom surface. Another aspect of the present invention includes an elongated lever having an upper surface, a lower surface opposing the upper surface, a first aperture extending through the upper surface, and a second aperture extending through the lower surface. A further aspect of the present invention provides a means for attaching the rod-like mounting portion of each tool head within the first or second apertures, such that an angle between the central axis and the lever surface is between 45 and 91 degrees, one tool head extending from the lever upper surface and another tool head extending from the lever lower surface.

In another embodiment of the present invention, a device for the paint-less dent repair of vehicles includes a first and second removable tool head, each including a work-piece contacting portion having a bottom surface, and a rod-like mounting portion. The rod-like mounting portion has a mounting end and a tip support end, a central axis extending from the mounting end to the tip support end, and a screw thread extending over a portion of the outer surface between the mounting and tip support ends. The tip support end is fixed to the bottom surface. Another aspect of the present invention includes an elongated lever having an upper surface, a lower surface opposing the upper surface, a first aperture extending through the upper surface, and a second aperture extending through the lower surface. A further aspect of the present invention provides a means for attaching the rod-like mounting portion of each tool head within the first or second apertures, such that an angle between the central axis and the lever surface is between 45 and 91 degrees, one tool head extending from the lever upper surface and another tool head extending from the lever lower surface.

In another embodiment of the present invention, a device for the paint-less dent repair of vehicles includes a first and second removable tool head, each including a base having a top surface and a bottom surface, and a work-piece contacting portion fixed to the top surface. Each tool heads further includes a rod-like mounting portion having a mounting end and a tip support end, a central axis extending from the mounting end to the tip support end, and a screw thread extending over a portion of the outer surface between the mounting and tip support ends. The tip support end is fixed to the bottom surface. Another aspect of the present invention includes an elongated lever device having a proximal end and a distal end, comprising two rod-like members of approximately equal length and oriented substantially parallel with each other. A further aspect of the present invention provides a means for attaching the rod-like mounting portions of each tool head to the two rod-like members at a position between said proximal end and said distal end.

In yet another embodiment of the present invention, a device for the paint-less dent repair of vehicles includes a first and second removable tool head, each including a work-piece contacting portion having a bottom surface, and a rod-like mounting portion. The rod-like mounting portion has a mounting end and a tip support end, a central axis extending from the mounting end to the tip support end, and a screw thread extending over a portion of the outer surface between the mounting and tip support ends. The tip support end is fixed to the bottom surface. Another aspect of the present invention includes an elongated lever device having a proximal end and a distal end, comprising two rod-like members of approximately equal length and oriented substantially parallel with each other. A further aspect of the present invention provides a means for attaching the rod-like mounting portions of each tool head to the two rod-like members at a position between said proximal end and said distal end.

BRIEF DESCRIPTION OF THE DRAWINGS

FIGS. 14*a*–*c* are side views of levers with attached tool heads, wherein the second tool head is placed against the panel to be straightened, the first tool head being placed against a rigid surface, according to an embodiment of the present invention.

FIGS. 15*a*–*c* are side views of levers with attached tool heads, wherein the first tool head is placed against the panel to be straightened, the second tool head being placed against a rigid surface, according to an embodiment of the present invention.

DETAILED DESCRIPTION OF THE PREFERRED EMBODIMENTS

It is an object of the present invention to provide a flexible, adaptable, low cost tool for use in paint-less vehicle panel repairs. The wide variety of dent shapes, body panel contours, panel thickness, and panel material requires a broad variety of tool tip shapes, tool tip compliance, and leverage force. These requirements are imposed on top of the requirement that the tool must be adaptable to fit into narrow, tight, oddly shaped spaces adjacent to the exterior body panel being repaired. Since no filler materials can be used in the repair to compensate for even minor contour irregularities, the original shape must be restored with a high degree of precision for the repair to be non-detectable. The tool tips must not create additional dents or damage, as this damage cannot be removed from inside the panel if it produces a "pimple" or other artifact that requires an external force on the painted surface to correct. Often, the restoring forces need be applied in multiple locations with different tool tips and varying force levels. This may mean the tool tip positions must be relocated frequently during the repair process. It may also mean that the basic shape of the leverage tool itself be altered to allow the tool to be used to apply the optimum restoring forces. The dented sheet metal often presents a sharp, somewhat conical shape when viewed from inside the damaged panel. Using a pointed tool of the prior art to straighten the dent is difficult because it results in the attempt to apply the restoring force through the points of two opposing cones. Therefore, embodiments of the present invention are designed to apply the restoring forces over a broader area, and through softer materials that will conform to the dent and remain in place as the restoring force is applied. Another feature of the present invention that is useful in restoring dented panels is one in which the broader tool head is rolled over a larger potion of the dent and the surrounding area, as the leverage force is applied.

Generally, the configuration of the apparatus of the present invention includes an elongated lever with two tool heads attached. The tool heads extend out of the lever at opposing directions, and are placed different positions along the length of the lever. The angle between the tool heads and the lever surface is not critical, and may vary from perpendicular to 45 degrees, preferably being substantially perpendicular. In use, one of the tool heads is placed against a relatively rigid surface oppositely disposed to the damaged panel being repaired, the other tool head being placed against a dent in the damaged panel. Force is placed on the lever in a direction to cause a restoring force to be placed against the dent. Tool heads have a threaded mounting shaft for mounting in holes or slots in the lever, and can be adjusted for position along the lever, as well as height above the lever surface.

Figure 1:
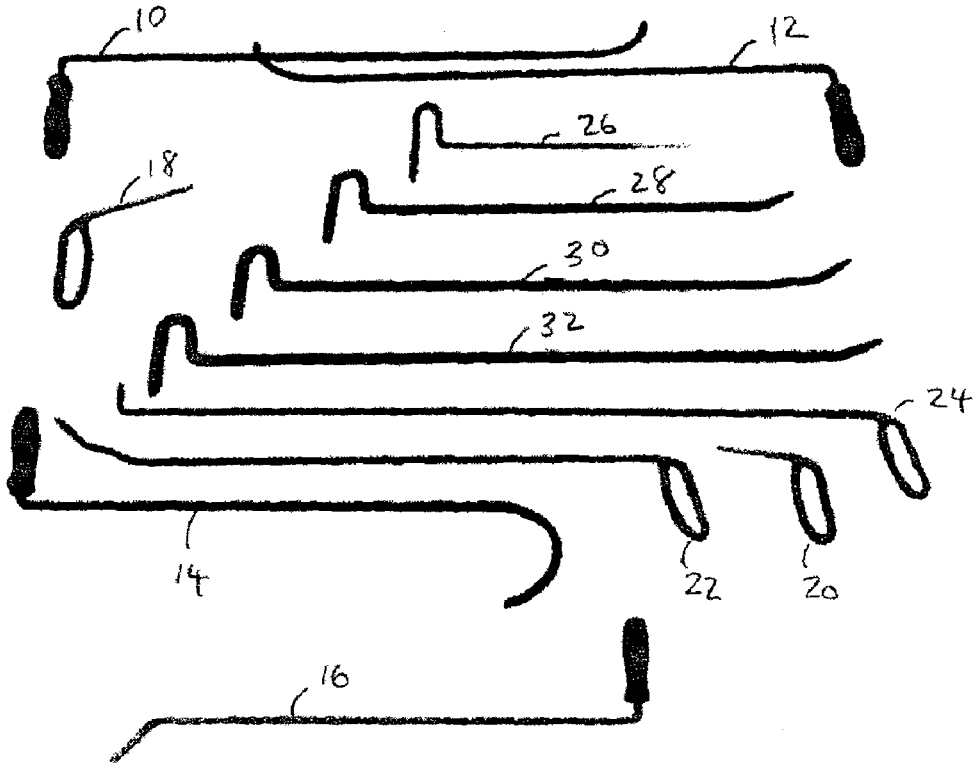
FIG. 1 (PRIOR ART)
FIG. 1 is a pictorial representation of a number of dent repair tools of the prior art.
Figure 2A:
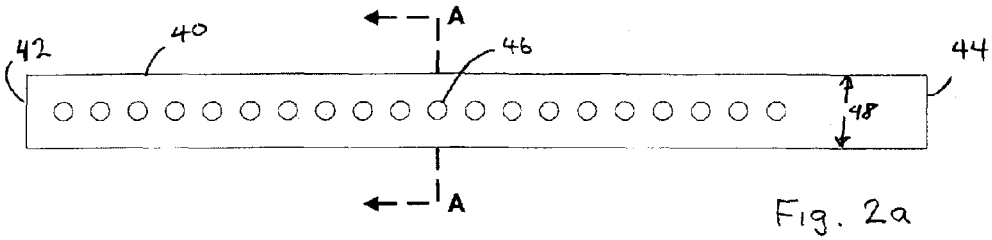
FIG. 2*a* is a plan view of a lever with holes for the attachment of tool tips according to an embodiment of the present invention.
Figure 2B:
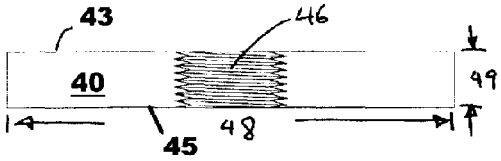
FIG. 2*b* is a sectional view along segment A—A of FIG. 2*a* for a lever with threaded holes according to an embodiment of the present invention.

FIG. 2*a* is a plan view of a lever 40 with holes 46 for the attachment of tool tips at discrete locations according to an embodiment of the present invention. The lever has a distal end 42 and a proximal end 44. The lever may have a circular, rectangular, or polygonal cross sectional shape, as viewed from one of the ends. Preferably, the lever should have a rectangular cross sectional shape, wherein the width 48 is greater than the thickness 49 (FIG. 2*b*). The lever 40 has a plurality of holes 46 extending through the thickness of the lever, located along a central axis running from the distal to the proximal ends. The holes may be threaded or smooth bore. The lever 40 may be made of a number of materials including wood, metal, composites, or plastics. Preferably, the lever 40 is made of metal. More preferably, the metal is malleable to allow the lever to be deformed into any desirable shape. The force required to plastically deform the lever 40 should preferably be greater than the force required to deform the vehicle panels being repaired.

FIG. 2*b* is a sectional view along segment A—A of FIG. 2*a* for a lever 40 with threaded holes 46 according to an embodiment of the present invention. A lever of rectangular cross section having a width 48, thickness 49, an upper surface 43 and a lower surface 45 is shown in this view.

Figure 3A:
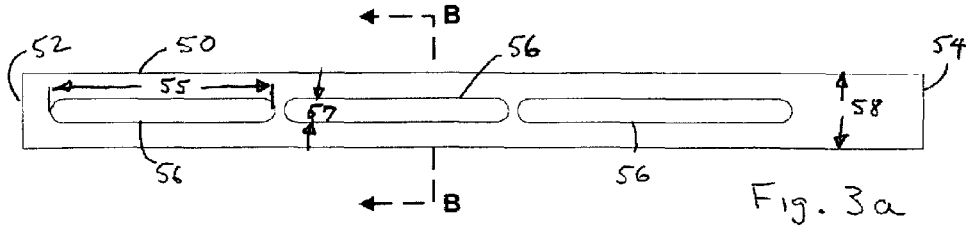
FIG. 3*a* is a plan view of a lever with slots for the attachment of tool tips according to an embodiment of the present invention.
Figure 3B:
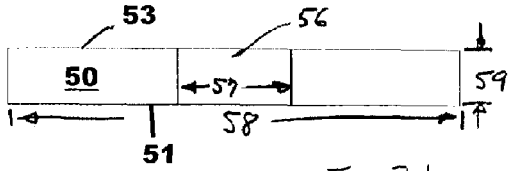
FIG. 3*b* is a sectional view along segment B—B of FIG. 3*a* for a lever with slots according to an embodiment of the present invention.

FIG. 3*a* is a plan view of a lever with slots for the attachment of tool tips according to an embodiment of the present invention. The lever has a distal end 52 and a proximal end 54. The lever may have a circular, rectangular, or polygonal cross sectional shape, as viewed from one of the ends. Preferably, the lever should have a rectangular cross sectional shape, wherein the width 58 is greater than the thickness 59 (FIG. 3*b*). The lever has a plurality of slots 56 extending through the thickness of the lever, located along a central axis running from the distal to the proximal ends. The slots should have a length 55 greater than their width 57, preferably having a length greater than twice their width. The slots 56 provide an advantage over the lever 40 in FIG. 2*a* in that the tool heads can be located in a more continuous fashion along the length of lever 50, without the requirement of having to be located at the specific discrete hole locations of lever 40. The lever 50 may be made of a number of materials including wood, metal, composites, or plastics. Preferably, the lever 50 is made of metal. More preferably, the metal is malleable to allow the lever to be deformed into any desirable shape. The force required to plastically deform the lever 50 should preferably be greater than the force required to deform the vehicle panels being repaired.

FIG. 3*b* is a sectional view along segment B—B of FIG. 3*a* for a lever 50 with slots 56 according to an embodiment of the present invention. A lever of rectangular cross section having a width 58, thickness 59, an upper surface 53 and a lower surface 51 is shown in this view.

Figure 4A:
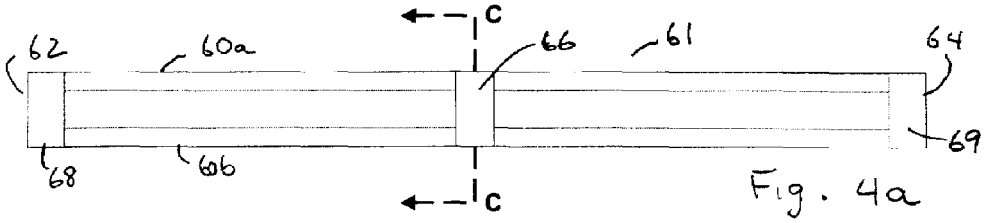
FIG. 4*a* is a plan view of a lever device comprising two parallel rods, according to an embodiment of the present invention.
Figure 4B:
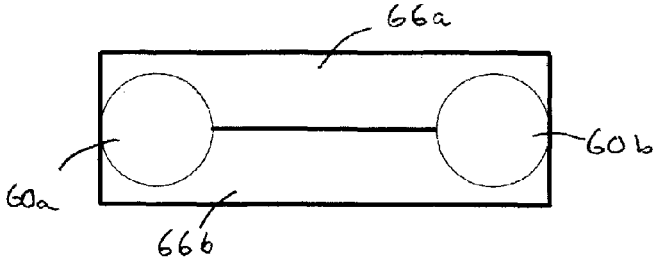
FIG. 4*b* is a sectional view along segment C—C of FIG. 4*a*.

FIG. 4*a* is a plan view of a lever device 61 comprising two parallel rods 60*a* and 60*b*, according to an embodiment of the present invention. The rods are held in alignment by clamps 66, 68, and 69. Although only three clamps are shown in FIG. 4*a*, it is understood that more may added if required. The rods 60 may have a square, polygonal, or circular cross section, but preferably have a circular cross section. The rods and clamps may be made of a number of materials including wood, metal, composites, or plastics. Preferably, the rods are made of metal. More preferably, the metal is malleable to allow the pair of rods to be deformed into any desirable shape. However, the parallel relationship of the rods must be maintained as the lever device 61 is deformed. The clamps may be made of any material consistent with the requirement of holding the rods in substantially parallel alignment to each other. The clamps 66, 68, 69 may be fastened to the rods 60 by adhesives, glue, solder, welding, or fasteners such as screws or bolts, or a combination of the preceding. The advantages of the lever device 61 are similar to those of the slotted lever 50, allowing a somewhat longer range of positional adjustment of the tool heads than both levers 40 and 50. FIG. 4*b* is a sectional view along segment C—C of FIG. 4*a*, showing a possible configuration of clamp 66.

Figure 5A:
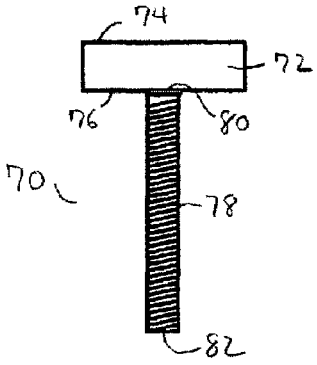
FIGS. 5*a*–5*l* are side views of a number of tool head configurations according to an embodiment of the present invention.

FIGS. 5*a*–5*l* are side views of a number of tool head configurations according to an embodiment of the present invention. In FIG. 5*a*, tool head 70 comprises work-piece contacting portion 72 and mounting portion 78. Mounting portion 78 has a tip support end 80 and a mounting end 82.

Work-piece contacting portion 72 has an upper surface 74 for placement against the work-piece, and a bottom surface 76 for fixed attachment to the tip support end 80 of mounting portion 78. Mounting portion 78 is of a generally cylindrical shape, having a threaded outer surface over at least a portion of its length. Mounting portion 78 may be made of metal, plastic, ceramic or composite materials, but preferably is made of metal. Work-piece contacting portion 72 may be made of metal, plastic, carbon fiber composite, fiberglass composite, rubber, leather, wood, solder, or layers or composites of these materials. The use of softer or more compliant materials (when compared to metals) may be desirable in order to prevent marking or damaging the thin sheet metal panels in modern vehicles. Work-piece contacting portion 72 is generally rigidly fixed to mounting portion 78, and may be connected by glue, solder, welding, or screws (not shown). The top views of this embodiment may be seen below in FIG. 7*a*, ref 270, 272, or 274.

Figure 5B:
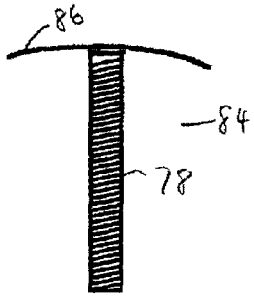

FIG. 5*b* is a side view of tool head 84, comprising a work-piece contacting portion 86 and mounting portion 78. Work-piece contacting portion 86 may be made of metal, layered composite (such as carbon fiber or fiberglass), or plastic. Preferably, work-piece contacting portion 86 is made of metal. Work-piece contacting portion 86 is generally rigidly fixed to mounting portion 78, and may be connected by glue, solder, welding, or screws (not shown). The top views of this embodiment may be seen below in FIG. 7*a*, ref 270, 272, or 274.

Figure 5C:
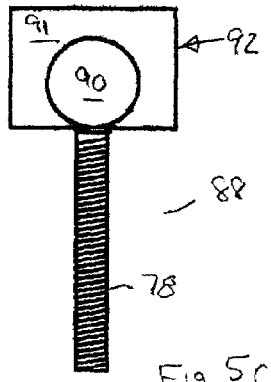

FIG. 5*c* is a side view of tool head 88, comprising a work-piece contacting portion 92 and mounting portion 78. Work-piece contacting portion 92 is further comprised of core 90 surrounded by outer layer 91. Core 90 is generally made of a harder material such as metal, rigid plastic, or ceramics, and is bonded to mounting portion 78. Outer layer 91 is placed over core 90 is generally made of a softer material than core 90. Outer layer 91 may be made of soft metals, solder, rubber, plastics, leather, or wood. Outer layer 91 may or may not be glued or bonded to core 90. For ease of replacement due to wear, outer layer 91 would not be permanently bonded to core 90. The top view of this embodiment may be seen below in FIG. 7*a*, ref 270, or 272.

Figure 5D:
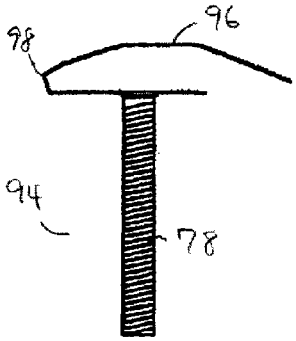

FIG. 5*d* is a side view of tool head 94, comprising a work-piece contacting portion 96 and mounting portion 78. Work-piece contacting portion 96 is made of metal, preferably spring steel. It may be made from a single sheet, bent at point 98. Work-piece contacting portion 96 is generally rigidly fixed to mounting portion 78, and may be connected by glue, solder, welding, or screws (not shown). The top view of this embodiment may be seen below in FIG. 7*a*, ref 272 or 274.

Figure 5E:
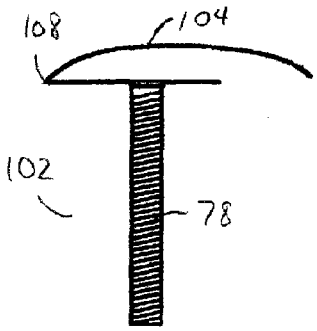

FIG. 5*e* is a side view of tool head 102, comprising a work-piece contacting portion 104 and mounting portion 78. Work-piece contacting portion 104 is made of metal, preferably spring steel. It may be made from two pieces of sheet, soldered or welded at point 108. Work-piece contacting portion 104 is generally rigidly fixed to mounting portion 78, and may be connected by glue, solder, welding, or screws (not shown). The top view of this embodiment may be seen below in FIG. 7*a*, ref 272 or 274.

Figure 5F:
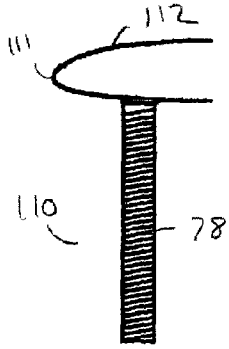

FIG. 5*f* is a side view of tool head 110, comprising a work-piece contacting portion 112 and mounting portion 78. Work-piece contacting portion 112 is made of metal, preferably spring steel. It may be made from a single sheet, mandrel bent at point 111. Work-piece contacting portion 96 is generally rigidly fixed to mounting portion 78, and may be connected by glue, solder, welding, or screws (not shown). The top view of this embodiment may be seen below in FIG. 7*a*, ref 272 or 274.

Figure 5G:
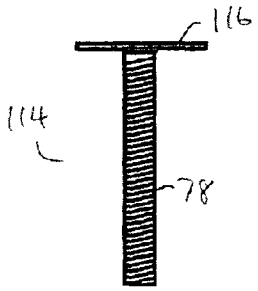

FIG. 5*g* is a side view of tool head 114, comprising a work-piece contacting portion 116 and mounting portion 78. Work-piece contacting portion 116 may be made of metal, layered composite, or plastic. Preferably, work-piece contacting portion 116 is made of metal. Work-piece contacting portion 116 is generally rigidly fixed to mounting portion 78, and may be connected by glue, solder, welding, or screws (not shown). The top views of this embodiment may be seen below in FIG. 7*a*, ref 270, 272, or 274.

Figure 5H:
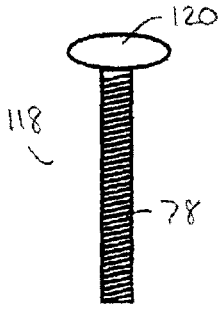

FIG. 5*h* is a side view of tool head 118, comprising a work-piece contacting portion 120 and mounting portion 78. Work-piece contacting portion 120 may be made of metal, plastic, rubber, leather, wood, or solder. Work-piece contacting portion 120 is generally rigidly fixed to mounting portion 78, and may be connected by glue, solder, welding, or screws (not shown). The top views of this embodiment may be seen below in FIG. 7*a*, ref 270, 272, or 274.

Figure 5I:
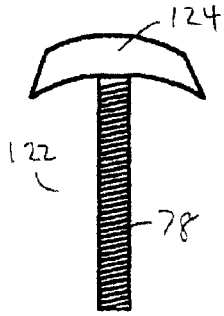

FIG. 5*i* is a side view of tool head 122, comprising a work-piece contacting portion 124 and mounting portion 78. Work-piece contacting portion 124 may be made of metal, plastic, carbon fiber composite, fiberglass composite, rubber, leather, wood, solder, or layers or composites of these materials. Work-piece contacting portion 124 is generally rigidly fixed to mounting portion 78, and may be connected by glue, solder, welding, or screws (not shown). The top views of this embodiment may be seen below in FIG. 7*a*, ref 270, 272, or 274.

Figure 5J:
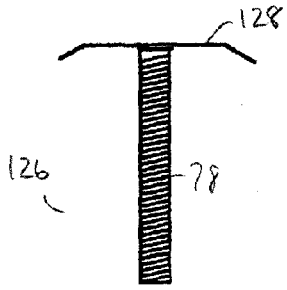

FIG. 5*j* is a side view of tool head 126, comprising a work-piece contacting portion 128 and mounting portion 78. Work-piece contacting portion 128 may be made of metal, layered composite (such as carbon fiber or fiberglass), or plastic. Preferably, work-piece contacting portion 86 is made of metal. Work-piece contacting portion 128 is generally rigidly fixed to mounting portion 78, and may be connected by glue, solder, welding, or screws (not shown). The top views of this embodiment may be seen below in FIG. 7*a*, ref 270, 272, or 274.

Figure 5K:
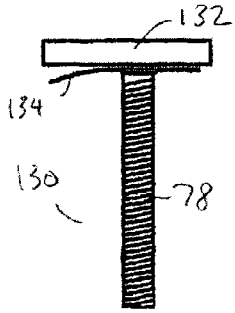

FIG. 5*k* is a side view of tool head 130, comprising a work-piece contacting portion 132, base 134, and mounting portion 78. Work-piece contacting portion 132 may be made of plastic, carbon fiber composite, fiberglass composite, rubber, leather, wood, or layers or composites of these materials. Base 134 may be made of metal, preferably spring steel. Base 134 may also be made of composite materials such as carbon fiber or fiberglass, for use when rubber or plastic materials are utilized in the work-piece contacting portion 132. Tool head 130 provides a work-piece contacting portion of variable compliance, with an initial bending compliance of portion 132, followed by a stiffer additional bending compliance of the base 134. The top view of this embodiment may be seen below in FIG. 7*a*, ref 272 or 274.

Figure 5L:
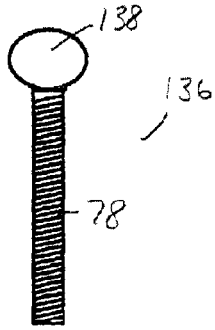

FIG. 5*l* is a side view of tool head 136, comprising a work-piece contacting portion 138 and mounting portion 78. This embodiment has a tighter radius of curvature when compared to the embodiment of FIG. 5*h*, for use on smaller or sharper dents. Work-piece contacting portion 138 may be made of metal, plastic, rubber, leather, wood, or solder. Work-piece contacting portion 138 is generally rigidly fixed to mounting portion 78, and may be connected by glue, solder, welding, or screws (not shown). The top views of this embodiment may be seen below in FIG. 7*a*, ref 270, 272, or 274.

Figure 6:
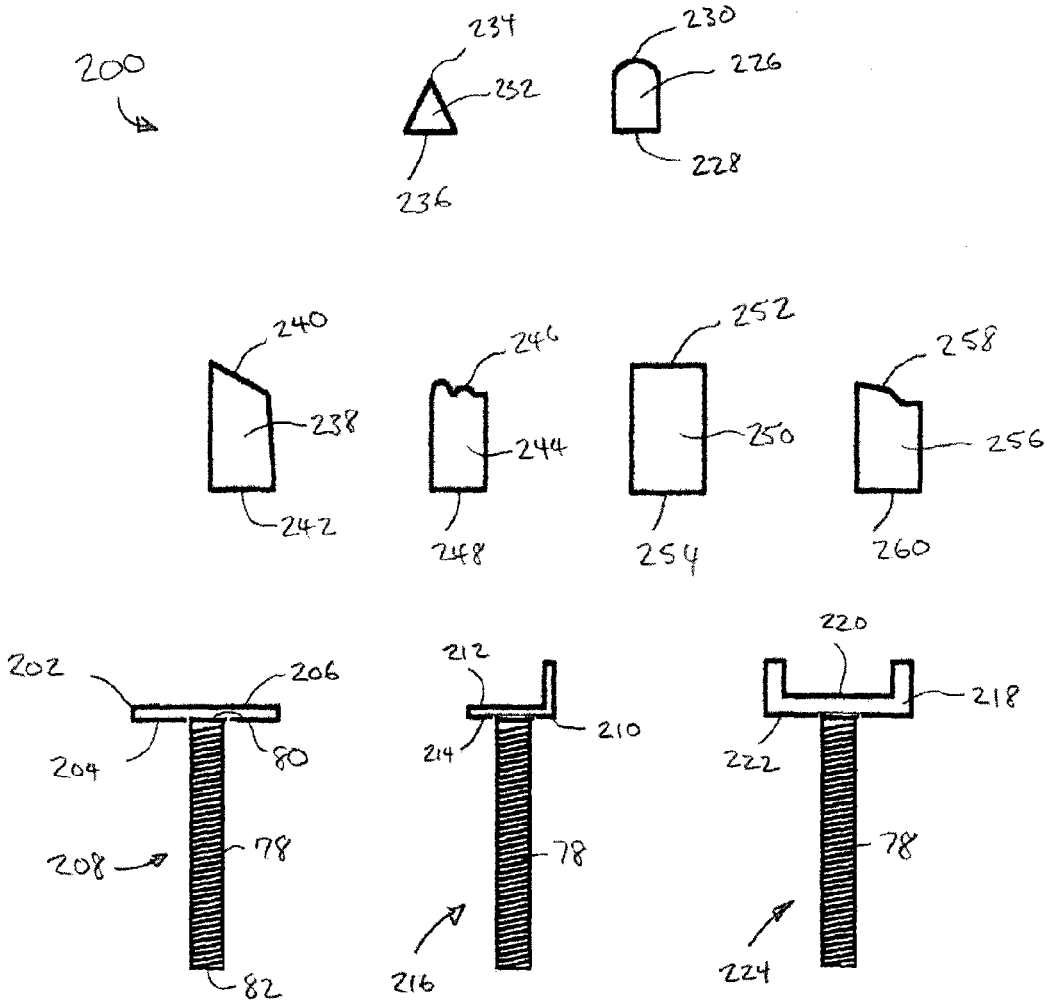
FIG. 6 is a side view of a variety of interchangeable tool head components according to an embodiment of the present invention.

In the foregoing tool head embodiments, the work-piece contacting portions and the mounting portions have been rigidly fixed together. It may desirable, however, to configure the tool heads with interchangeable and replaceable work-piece contacting tips. FIG. 6 is a side view of a variety of interchangeable tool head components according to an embodiment of the present invention. Work-piece contacting portions 226, 232, 238, 244, 250, and 256 may be used interchangeably with tool mounting base assemblies 208, 216, and 224. Tool mount base assembly 208 comprises base 202 having a top surface 206 and bottom surface 204, and a mounting portion 78 having a tip support end 80 and a mounting end 82. Base 202 is permanently fixed to the tip support end 80 at its bottom surface 204. Tool mount base assembly 216 comprises base 210 having a top surface 212 and bottom surface 214, and a mounting portion 78 fixed to the bottom surface 214. Tool mount base assembly 224 comprises base 218 having a top surface 220 and bottom surface 222, and a mounting portion 78 fixed to the bottom surface 222. Work-piece contacting portions 226, 232, 238, 244, 250, and 256 have a work-piece contacting surfaces 230, 234, 240, 246, 252, and 258, respectively. Work-piece contacting portions 226, 232, 238, 244, 250, and 256 have bottom mounting surfaces 228, 236, 242, 248, 254, and 260, respectively. The bottom mounting surfaces of the work-piece contacting portions are attached to the top surfaces 206, 212, and 220 of the bases. The attachment means may be non-permanent adhesives, screws, rivets, solder or other compatible means known in the art. Work-piece contacting portions 226, 232, 238, 244, 250, and 256 may be made of metal, plastic, rubber, leather, wood, or solder. Top views of the tool mount base assemblies 208, 216, and 224 of this embodiment may be seen below in FIG. 7*b*.

Figure 7A:
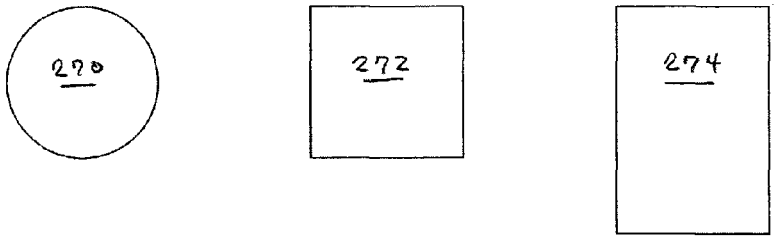
FIG. 7*a* is a plan view of the tool heads shown in FIGS. 5*a*–5*l* according to an embodiment of the present invention.

FIG. 7*a* is a plan view of the tool heads shown in FIGS. 5*a*–5*l* according to an embodiment of the present invention. Tool heads 70, 84, 114, 118, 124, 126, 136 may be configured having a circular profile 270, square profile 272, or rectangular profile 274. Tool head 88 may be configured having a circular profile 270, square profile 272. Tool heads 94, 102, 110, and 126 may be configured having square profile 272, or rectangular profile 274.

Figure 7B:
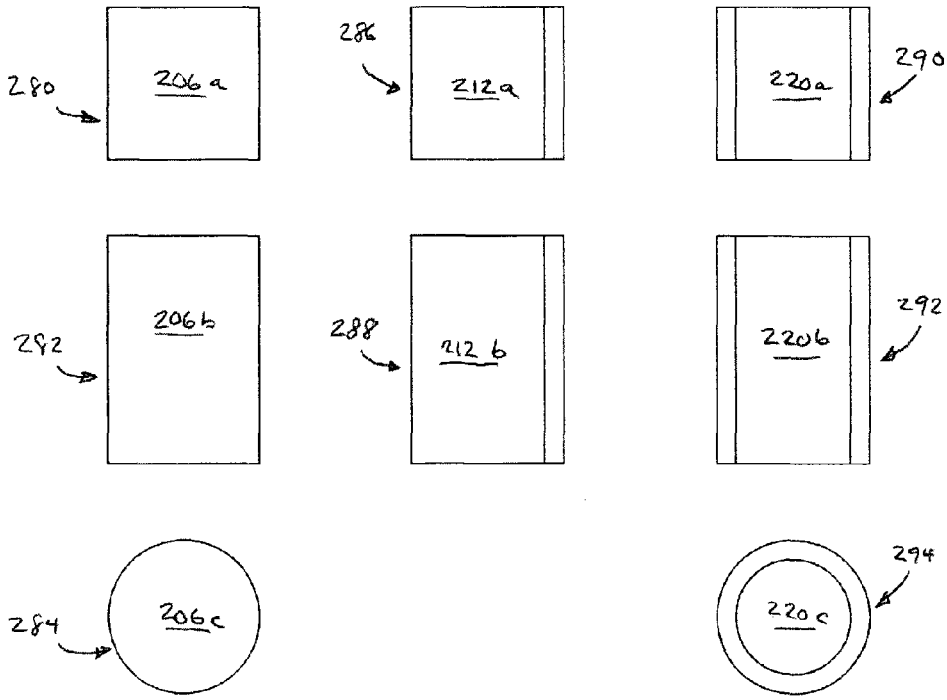
FIG. 7*b* is a plan view of the tool heads shown in FIG. 6 according to an embodiment of the present invention.

FIG. 7*b* is a plan view of the tool heads shown in FIG. 6 according to an embodiment of the present invention. Tool head mounting base 208 may be configured having a square profile 280, a rectangular profile 282, or a circular profile 284, having upper surfaces 206*a*–206*c*, respectively. Tool head mounting base 224 may be configured having a square profile 290, a rectangular profile 292, or a circular profile 294, having upper surfaces 220*a*–220*c*, respectively. Tool head mounting base 216 may be configured having a square profile 286, or a rectangular profile 288, having upper surfaces 212*a*, 212*b*, respectively.

Figure 8:
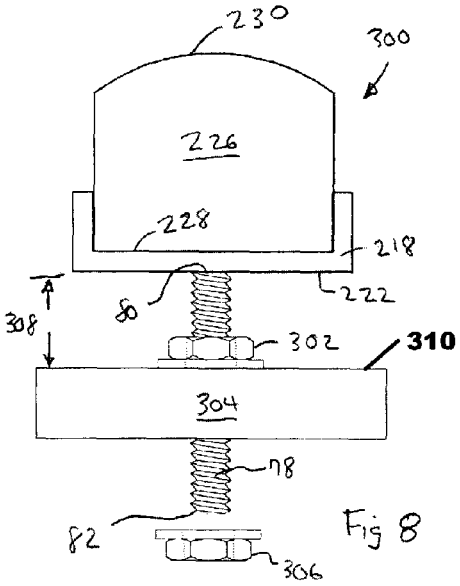
FIG. 8 is a distal end view of a tool head mounted on the lever of FIG. 2*a* according to an embodiment of the present invention.

The foregoing depiction has provided a detailed description of the individual tool heads and lever devices. The subsequent dissertation outlines the means for attaching the tool heads to the lever device, and few examples of how the tool is used. FIG. 8 is a distal end view of a tool head mounted on the lever of FIG. 2*a* according to an embodiment of the present invention. For illustrative purposes, tool head assembly 300 comprises: tool mount base assembly 224, having a base 218; work-piece contacting portion 226, lever 304, and jam nut/washer assembly 302. For a lever having threaded holes, as shown in FIG. 2*b*, jam nut 302 is all that is required to attach mounting portion 78 to lever 304. The height 308 of base 218 above the surface may be adjusted by turning the mounting base prior locking the jam nut with the surface of lever 304. For the case of non-threaded mounting holes or slots, a second jam nut/washer 306 is required attach mounting portion 78 to lever 304. Height 308 is adjusted by the relative positions of jam nuts 302 and 306 on mounting portion 78. The angle between the central axis of mounting portion 78 and surface 310 is not critical, and may vary from perpendicular to 45 degrees. Preferably, the angle should be substantially perpendicular. Although tool mount assembly 224 has been used in this example, it should be evident to those of ordinary skill in the art that any of the previously described tool head embodiments could have been used interchangeably without loss of functionality.

Figure 9:
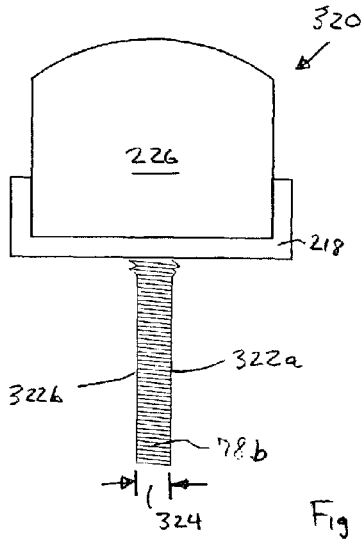
FIG. 9 is a front elevation view of a tool head for mounting on the slotted lever of FIG. 3*a* according to an embodiment of the present invention.
Figure 10A:
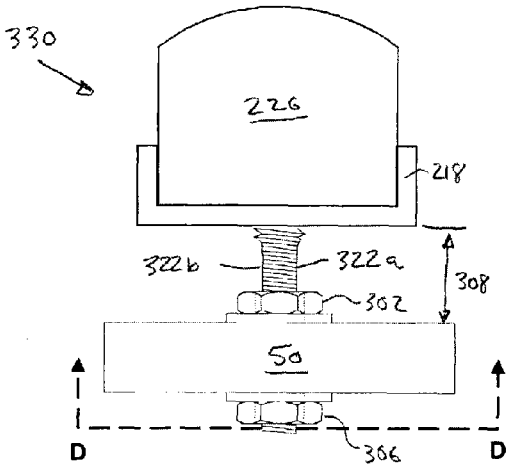
FIG. 10*a* is a distal end view of a tool head of FIG. 9 mounted on the slotted lever of FIG. 3*a* according to an embodiment of the present invention.
Figure 10B:
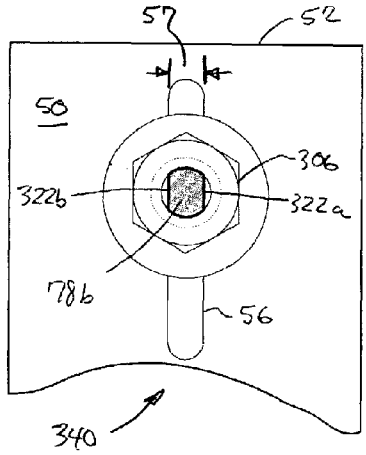
FIG. 10*b* is a bottom partial sectional view along segment D—D of FIG. 10*a*.

In some cases, it may be desirable to be able to mount and adjust the position of tool heads without having to adjust the rotational position of the tool heads with respect to the lever. FIG. 9 is a front elevation view of a tool head for mounting on the slotted lever of FIG. 3*a* according to an embodiment of the present invention. Mounting portion 78*b* is provided with two opposing parallel surfaces, 322*a* and 322*b*, placed at a distance 324 from on another. Distance 324 will be typically less that the thread root diameter of mounting portion 78, and less than the inside width of the slot 57. The minimum acceptable dimension for distance 324 will be determined by the material makeup of 78*b* in combination with the forces experienced by the tool in use. FIG. 10*a* is a distal end view of a tool head of FIG. 9 mounted on the slotted lever 50 of FIG. 3*a* according to an embodiment of the present invention. As in an embodiment described previously, two jam nuts 302 and 306 are required to adjust height 308 and attach mounting portion 78*b* to lever 50. FIG. 10*b* is a bottom partial sectional view along segment D—D of FIG. 10*a*, showing the bottom view detail of mounting portion 78*b* in relation to slot 56 and jam nut 306. Loosening either jam nuts will allow the tool head position to be adjusted in small increments within the slot.

Figure 11A:
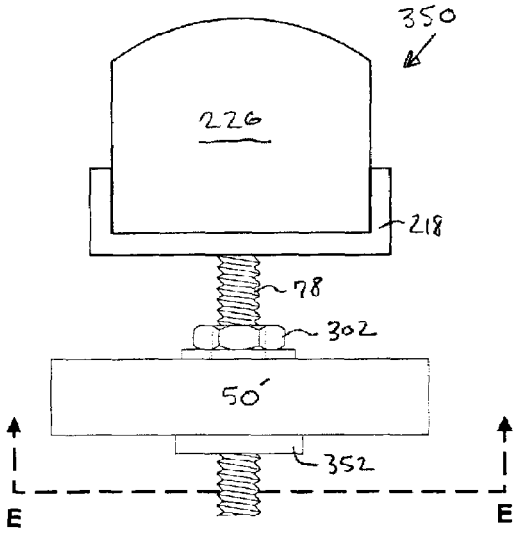
FIG. 11*a* is a distal end view of a tool head mounted on a slotted lever according to another embodiment of the present invention.
Figure 11B:
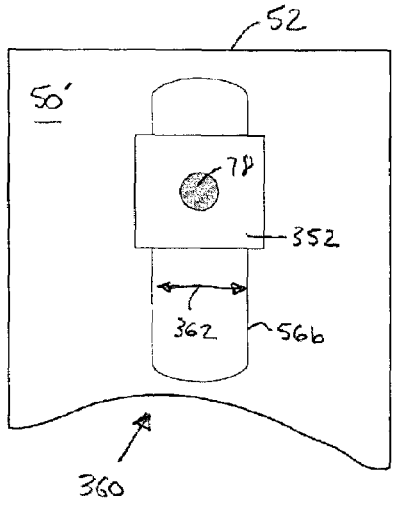
FIG. 11*b* is a bottom partial sectional view along segment E—E of FIG. 11*a*.
Figure 12A:
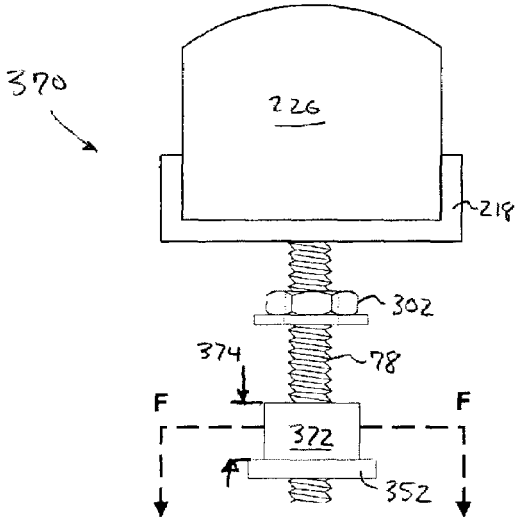
FIG. 12*a* is a front elevation view of the tool head of FIG. 11*a*, according to an embodiment of the present invention.
Figure 12B:
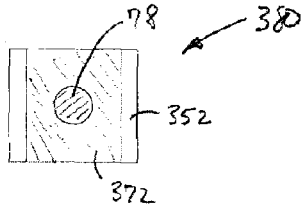
FIG. 12*b* is a sectional view along segment F—F of FIG. 12*a*.

A disadvantage of the foregoing embodiment is the need to machine the mounting shafts, perhaps requiring an additional set of tool heads just to fit a slotted lever. Please refer to FIGS, 11*a*, 11*b*, 12*a*, and 12*b* for the following discussion. FIG. 11*a* is a distal end view of a tool head mounted on a slotted lever according to another embodiment of the present invention. FIG. 11*b* is a bottom partial sectional view along segment E—E of FIG. 11*a*. FIG. 12*a* is a front elevation view of the tool head of FIG. 11*a*, according to an embodiment of the present invention. FIG. 12*b* is a sectional view along segment F—F of FIG. 12*a*. This embodiment utilizes tool heads without the requirement to add parallel surfaces 322 to mounting portion 78. Assembly 350 comprises, for example, tool mount base assembly 224, lever 50', jam nut/washer assembly 302, and "tee" nut 380 (FIG. 12*b*). The top portion 372 of the "tee" nut 380 fits within slot 362, having dimension 374 less than the thickness of lever 50'. Loosening jam nut 302 slightly allows the tool head position to be adjusted in small increments within the slot. Jam nut 302, and "tee" nut 380 are required attach mounting portion 78 to slotted lever 50'.

Figure 13:
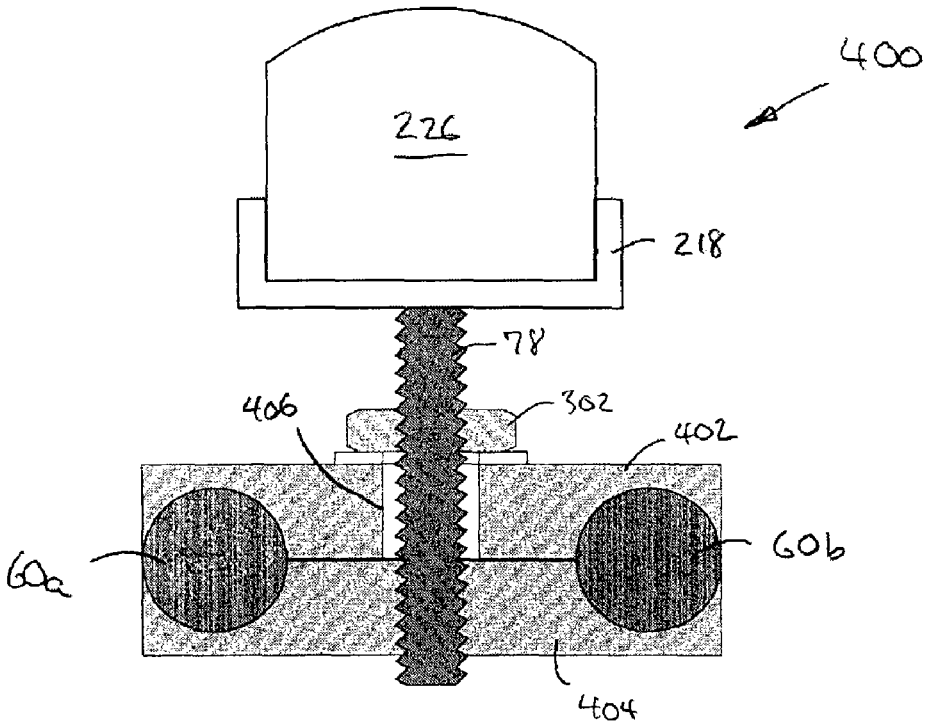
FIG. 13 is a is sectional view of a means for attaching tool heads to the lever device in FIG. 4*a*, according to an embodiment of the present invention.

FIG. 13 is a is sectional view of a means for attaching tool heads to the lever device in FIG. 4*a*, according to an embodiment of the present invention. In this embodiment, for example, the mounting portion 78 of tool mount base assembly 224 engages a threaded hole in the lower section 404 of a two piece clamp assembly 402, 404. Both the upper section 402 and lower section 404 slideably engage rods 60*a* and 60*b* of lever device 61, and allow translating movement of the tool head along the length of the lever device. Upper clamp section 402 is provided with a clearance hole 406 to allow mounting portion 78 to pass through to the lower clamp section 404. Jam nut 302, when tightened against upper clamp section, causes the clamp to grip rods 60*a* and 60*b*, locking the tool head and clamp into position.

FIGS. 14*a–c* are side views of levers with attached tool heads, wherein the second tool head is placed against the panel to be straightened, the first tool head being placed against a rigid surface, according to an embodiment of the present invention. FIG. 14*a* shows, as an example, an essentially straight lever 40*a* and two tool heads 512 and 516 positioned at heights 506 and 508 above the lever surface, respectively. First tool head 512 is mounted proximate to the distal end of lever 40*a* with its work-piece contacting surface 514 placed against a rigid surface 502. Second tool head 516 is positioned between the first tool head and the proximal end of lever 40*a*, with its work-piece contact surface 518 placed against the panel to be straightened. A force 510 is applied proximate to the proximal end of lever 40*a* to push the contour of the damaged panel 504 back to its original shape. In actual practice, this may require a number of applications of force, perhaps requiring different tool heads of different shapes and materials, as well as a repositioning of the tool heads on the lever. Additionally, the lever is preferably made of materials that allow the user to alter its shape to conform to the confines of space within which the repair must be carried out. Examples of curved and shaped levers are shown in FIGS. 14*b* and 14*c*. FIG. 14*b* shows, as an example, a curved lever 40*b* and two tool heads 512 and 516 positioned at heights 603 and 605 above the lever surface, respectively. First tool head 512 is mounted proximate to the distal end of lever 40*b* with its work-piece contacting surface placed against a rigid surface 602. Second tool head is positioned between the first tool head and the proximal end of lever 40*b*, with its work-piece contact surface placed against the panel 604 to be straightened. A force 606 is applied proximate to the proximal end of lever 40*b* to push the contour of the damaged panel 604 back to its original shape. Note that the lever may be shaped to accommodate the relative positions of surfaces 602 and 604, which may not be parallel or directly opposed to each other. FIG. 14*c* shows, as an example, lever 40*c* bent and shaped to fit within a narrow space. The shape of lever 40*c* in combination with adjustment of heights 703 and 705, allow the tool to fit within a the narrow space between surfaces 702 and 704, and allow the restoring force 706 to be applied to straighten the panel.

FIGS. 15*a–c* are side views of levers with attached tool heads, wherein the first tool head is placed against the panel to be straightened, the second tool head being placed against a rigid surface, according to an embodiment of the present invention. When compared to the embodiments of FIGS. 14*a–c*, the embodiments of FIGS. 15*a–c* produce considerably less force on the dented panels. This is due to the physics of leverage, wherein it can be shown that the forces at the fulcrum of a lever (i.e. the tool head between the applied force and the tool head mounted at the distal end of the lever) will be the sum of the applied force and the force at the distal end of the lever. It may be desirable, with thinner panels, to have more control by applying lower forces. In that case, better control can be obtained by reversing the positions of the function of the tool heads, applying the tool head mounted on the distal against the panel to be repaired. FIG. 15*a* shows, as an example, an essentially straight lever 40*a* and two tool heads 512 and 516. First tool head 516 is mounted proximate to the distal end of lever 40*a* with its work-piece contacting surface placed against the panel 804 to be straightened. Second tool head 512 is positioned between the first tool head 516 and the proximal end of lever 40*a*, with its work-piece contact surface placed against a rigid surface 802. A force 806 is applied proximate to the proximal end of lever 40*a* to push the contour of the damaged panel 804 back to its original shape. FIG. 15*b* shows, as an example, a curved lever 40*b* and two tool heads 512 and 516. First tool head 516 is mounted proximate to the distal end of lever 40*b* with its work-piece contacting surface placed against the panel 904 to be straightened. Second tool head 512 is positioned between the first tool head 516 and the proximal end of lever 40*b*, with its work-piece contact surface placed against a rigid surface 902. A force 906 is applied proximate to the proximal end of lever 40*b* to push the contour of the damaged panel 604 back to its original shape. FIG. 15*c* shows, as an example, lever 40*c* bent and shaped to fit within a narrow space. The shape of lever 40*c* allows the tool to fit within a the narrow space between surfaces 1002 and 1004, allowing the restoring force 1006 to be applied to straighten the panel.

What is claimed is:

1. A device for the paint-less dent repair of vehicles, for applying a leverage force between a rigid internal structure and an inside surface of a panel to be straightened, comprising:

a first removable tool head, including
- a first base, having a first top surface and a first bottom surface,
- a first work-piece contacting portion fixed to said first top surface, and
- a first rod-like mounting portion having a first mounting end and a first tip support end,
- a first central axis extending from the first mounting end to the first tip support end, and
- a screw thread extending over at least a portion of an outer surface between the first mounting and the first tip support ends, wherein said first tip support end is fixed to said first bottom surface;

a second removable tool head, including
- a second base, having a second top surface and a second bottom surface,
- a second work-piece contacting portion fixed to said second top surface, and
- a second rod-like mounting portion having a second mounting end and a second tip support end,
- a second central axis extending from the second mounting end to the second tip support end, and
- a screw thread extending over at least a portion of an outer surface between the second mounting and the second tip support ends, wherein said second tip support end is fixed to said second bottom surface;

an elongated lever having an upper surface, a lower surface opposing said upper surface, a first aperture extending through said upper surface, and a second aperture extending through said lower surface;

a means for attaching the first rod-like mounting portion within said first aperture, such that an angle between said first central axis and said upper surface is between 45 and 91 degrees, wherein said first work-piece contacting portion is above said upper surface; and a means for attaching the second rod-like mounting portion within said second aperture, such that an angle between said second central axis and said lower surface is between 45 and 91 degrees, wherein said second work-piece contacting portion is below said lower surface.

2. A device as recited in claim 1 wherein said elongated lever is comprised of a malleable material, wherein a force required to plastically deform said lever is greater than a force required to straighten a panel.

3. A device as recited in claim 1, wherein said first aperture and said second aperture are threaded holes.

4. A device as recited in claim 1, wherein said first aperture and said second aperture are slots.

5. A device as recited in claim 1, wherein said first and said second work-piece contacting portions are made from a material selected from the group consisting of metal, wood, plastic, rubber, carbon fiber composite, fiberglass composite, and solder.

6. A device as recited in claim 5, wherein said first and second work-piece contacting portions comprise:

an inner core, and an outer layer; wherein the inner core is of a harder material than the outer layer.

7. A device as recited in claim 1, wherein a first dimension between said first bottom surface and said upper surface, and a second dimension between said second bottom surface and said lower surface, are adjustable.

8. A device for the paint-less dent repair of vehicles, for applying a leverage force between a rigid internal structure and an inside surface of a panel to be straightened, comprising:

a first removable tool head, including a first work-piece contacting portion, having a first bottom surface, a first rod-like mounting portion having a first mounting end and a first tip support end, a first central axis extending from the first mounting end to the first tip support end, and a screw thread extending over at least a portion of an outer surface between the first mounting and the first tip support ends, wherein said first tip support end is fixed to said first bottom surface;

a second removable tool head, including a second work-piece contacting portion, having a second bottom surface, a second rod-like mounting portion having a second mounting end and a second tip support end, a second central axis extending from the second mounting end to the second tip support end, and a screw thread extending over at least a portion of an outer surface between the second mounting and the second tip support ends, wherein said second tip support end is fixed to said second bottom surface;

an elongated lever having an upper surface, a lower surface opposing said upper surface, a first aperture extending through said upper surface, and a second aperture extending through said lower surface;

a means for attaching the first rod-like mounting portion within said first aperture, such that an angle between said first central axis and said upper surface is between 45 and 91 degrees, wherein said first work-piece contacting portion is above said upper surface; and a means for attaching the second rod-like mounting portion within said second aperture, such that an angle between said second central axis and said lower surface is between 45 and 91 degrees, wherein said second work-piece contacting portion is below said lower surface.

9. A device as recited in claim 8 wherein said elongated lever is comprised of a malleable material, wherein a force required to plastically deform said lever is greater than a force required to straighten a panel.

10. A device as recited in claim 8, wherein said first aperture and said second aperture are threaded holes.

11. A device as recited in claim 8, wherein said first aperture and said second aperture are slots.

12. A device as recited in claim 8, wherein said first and said second work-piece contacting portions are made from a material selected from the group consisting of metal, wood, plastic, rubber, carbon fiber composite, fiberglass composite, and solder.

13. A device as recited in claim 12, wherein said first and second work-piece contacting portions comprise:

an inner core, and an outer layer; wherein the inner core is of a harder material than the outer layer.

14. A device as recited in claim 8, wherein a first dimension between said first bottom surface and said upper surface, and a second dimension between said second bottom surface and said lower surface, are adjustable.

15. A device for the paint-less dent repair of vehicles, for applying a leverage force between a rigid internal structure and an inside surface of a panel to be straightened, comprising:

a first removable tool head, including a first base, having a first top surface and a first bottom surface, a first work-piece contacting portion fixed to said first top surface, and a first rod-like mounting portion having a first mounting end and a first tip support end, a first central axis extending from the first mounting end to the first tip support end, and a screw thread extending over at least a portion of an outer surface between the first mounting and the first tip support ends, wherein said first tip support end is fixed to said first bottom surface;

a second removable tool head, including a second base, having a second top surface and a second bottom surface, a second work-piece contacting portion fixed to said second top surface, and a second rod-like mounting portion having a second mounting end and a second tip support end, a second central axis extending from the second mounting end to the second tip support end, and a screw thread extending over at least a portion of an outer surface between the second mounting and the second tip support ends, wherein said second tip support end is fixed to said second bottom surface;

an elongated lever device having a proximal end and a distal end, comprising two rod-like members, of approximately equal length and oriented substantially parallel with each other;

a means for attaching the first rod-like mounting portion to said two rod-like members at a first position between said proximal end and said distal end; and a means for attaching the second rod-like mounting portion to said two rod-like members at a second position between said proximal end and said distal end.

16. A device as recited in claim 15 wherein said elongated lever is comprised of a malleable material, wherein a force required to plastically deform said lever is greater than a force required to straighten a panel.

17. A device as recited in claim 15, wherein said first and said second work-piece contacting portions are made from a material selected from the group consisting of metal, wood, plastic, rubber, carbon fiber composite, fiberglass composite, and solder.

18. A device as recited in claim 17, wherein said first and second work-piece contacting portions comprise:

an inner core, and an outer layer; wherein the inner core is of a harder material than the outer layer.

19. A device for the paint-less dent repair of vehicles, for applying a leverage force between a rigid internal structure and an inside surface of a panel to be straightened, comprising:

a first removable tool head, including a first work-piece contacting portion, having a first bottom surface, a first rod-like mounting portion having a first mounting end and a first tip support end, a first central axis extending from the first mounting end to the first tip support end, and a screw thread extending over at least a portion of an outer surface between the first mounting and the first tip support ends, wherein said first tip support end is fixed to said first bottom surface;

a second removable tool head, including a second work-piece contacting portion, having a second bottom surface, a second rod-like mounting portion having a second mounting end and a second tip support end, a second central axis extending from the second mounting end to the second tip support end, and a screw thread extending over at least a portion of an outer surface between the second mounting and the second tip support ends, wherein said second tip support end is fixed to said second bottom surface;

an elongated lever device having a proximal end and a distal end, comprising two rod-like members, of approximately equal length and oriented substantially parallel with each other;

a means for attaching the first rod-like mounting portion to said two rod-like members at a first position between said proximal end and said distal end; and a means for attaching the second rod-like mounting portion to said two rod-like members at a second position between said proximal end and said distal end.

20. A device as recited in claim 19 wherein said elongated lever is comprised of a malleable material, wherein a force required to plastically deform said lever is greater than a force required to straighten a panel.

21. A device as recited in claim 19, wherein said first and said second work-piece contacting portions are made from a material selected from the group consisting of metal, wood, plastic, rubber, carbon fiber composite, fiberglass composite, and solder.

22. A device as recited in claim 21, wherein said first and second work-piece contacting portions comprise:

an inner core, and an outer layer; wherein the inner core is of a harder material than the outer layer.

* * * * *